US005259539A

United States Patent [19]

Brotman

[11] Patent Number: 5,259,539

[45] Date of Patent: Nov. 9, 1993

[54] SUIT BAG HAVING BACK PACK MOUNT

[76] Inventor: Stuart Brotman, 2 Corte Palos Verdes, Tiburon, Calif. 94920

[21] Appl. No.: 820,707

[22] Filed: Jan. 14, 1992

[51] Int. Cl.[5] ..... B65D 85/18

[52] U.S. Cl. ..... 224/209; 190/13 R; 190/127; 224/153; 224/210; 224/211; 224/907

[58] Field of Search ..... 190/1, 13 R, 102, 107, 190/111, 119, 127; 224/151, 153, 209, 210, 211, 215, 907

[56] References Cited

U.S. PATENT DOCUMENTS

| | | | |
|---|---|---|---|
| 2,456,247 | 12/1948 | Bernau | 224/209 |
| 3,433,335 | 3/1969 | Spitz | 190/109 X |
| 3,484,309 | 12/1966 | Komroff | 190/1 |
| 3,960,300 | 6/1976 | Dickler | 224/210 |
| 4,420,103 | 12/1983 | Douglass | 224/210 |
| 4,609,084 | 9/1986 | Thomas | 224/209 X |
| 4,809,893 | 3/1989 | Parsons | 224/210 |
| 4,830,245 | 5/1989 | Arakaki | 224/907 X |
| 4,901,897 | 2/1990 | Briggs et al. | 224/209 X |
| 4,953,674 | 9/1990 | Landes | 190/102 X |
| 5,004,135 | 4/1991 | Dufournet et al. | 224/210 |
| 5,031,766 | 7/1991 | Cohen | 190/102 X |

*Primary Examiner*—Allan N. Shoap
*Assistant Examiner*—Christopher McDonald
*Attorney, Agent, or Firm*—Townsend and Townsend

[57] ABSTRACT

A back pack type suit bag is disclosed having an incorporated semirigid panel enclosed in a side wall of the bag. The semirigid panel defines the profile of the upper portion of the bag and supports the upper hanger strap from which garments are supported. A conventional and flexible bag wall is provided with the bag opening, typically a zipper, to obtain access to the interior of the bag. On the other side of the semirigid panel from the exterior of the bag "back pack" type shoulder straps are fastened. The back pack shoulder straps are attached about the shoulders of the wearer to impart a slight arcurate bend to the semirigid panel with such bending occuring about an axis parallel to the spine of the bag wearer. Preferably, a waist strap is additionally utilized and similarly tightened to reinforce the arch. There results a rigid column type support from the shoulder straps to the hanging point of the garments interior of the bag, a comfortable and conformed fit of the bag to the back of the wearer, as well as a surrounding encasement of the garment by the semirigid panel.

10 Claims, 1 Drawing Sheet

SUIT BAG HAVING BACK PACK MOUNT

This invention relates to a bag for carrying garments. More particularly, a garment bag is disclosed which is capable of being mounted in "back pack" fashion to the back of a person carrying the garment bag so that garments such as suits may be conveniently transported without wrinkles or other damage by a person undergoing physical activity—such as riding a bicycle.

BACKGROUND OF THE INVENTION

Bags for holding suits and hanging garments are well known. Typically, such bags are provided with a mechanism to which a conventional hanger fastens. Thereafter, the bag is crafted about the hanger suspension point to surround the garment. Typically such bags completely enclose the garment being carried. Thereafter, the bags themselves are folded with the contained garment inside.

It further is known to place on such bags "back pack" type straps. Usually, such straps have placement as an afterthought with respect to the construction of the bag. The result is that the bag—although it can be supported by the attached "back pack" type straps—is not acting with the back of the wearer in a true pack like configuration. Such bags typically produce folded and wrinkled garments at their respective destinations and are extremely uncomfortable.

Examples of folding suit bags can be found in Smallberg U.S. Pat. No. 2,774,450 issued Dec. 18, 1956; Dickler U.S. Pat. No. 4,066,195 issued Jan. 3, 1978; Briggs et al. U.S. Pat. No. 4,901,897 issued Feb. 20, 1990; Pulichino, Jr. et al. U.S. Pat. No. 4,753,342 issued Jun. 28, 1988; and King U.S. Pat. No. 4,736,839 issued Apr. 12, 1988.

Examples of bags have "back pack" type straps fastened to bags include Lane et al. U.S. Pat. No. 4,655,343 issued Apr. 7, 1987; Schultz U.S. Pat. No. 4,604,765 issued Aug. 12, 1986; and, McArthur U.S. Pat. No. 4,883,207 issued Nov. 28, 1989.

SUMMARY OF THE INVENTION

A back pack type suit bag is disclosed having an incorporated semirigid panel enclosed in a side wall of the bag. The semirigid panel defines the profile of the upper portion of the bag and supports the upper hanger strap from which garments carried in the bag are supported. The semirigid wall is co-extensive with the full width of the bag and forms at least part of one wall of the garment or suit carrying bag. On one side of the semirigid panel, the remainder of the garment carrying bag is defined including the bag side walls and remaining conventional and flexible bag wall for enclosing the garment. This conventional and flexible bag wall is preferably provided with the bag opening, typically a zipper, to obtain access to the interior of the bag. On the other side of the semirigid panel from the exterior of the bag, "back pack" type shoulder straps are fastened. In use, the bag is packed with a garment and the panel is addressed at the reverse exterior side of the bag to the back of the wearer. The back pack shoulder straps are attached about and preferably fastened tightly over the shoulders of the wearer to impart a slight arcuate bend to the semirigid panel with such bending occurring about an axis parallel to the spine of the bag wearer. Preferably, a waist strap is additionally utilized and similarly tightened with the result that the panel and attached pack fits reinforcing the arch having an axis parallel to the spine of the wearer. There results a rigid column type support from the shoulder straps to the hanging point of the garments interior of the bag, a comfortable and conformed fit of the bag to the back of the wearer, as well as a surrounding encasement of the garment or suit by the semirigid panel in a substantially "wrinkle free" containment. Provision can be made so that the panel only occupies a portion of one side of the bag with the depending portion of the bag being folded up and attached to conventional clips for supporting any depending portion of the bag below the panel.

DESCRIPTION OF THE PREFERRED EMBODIMENT

Figure 1:
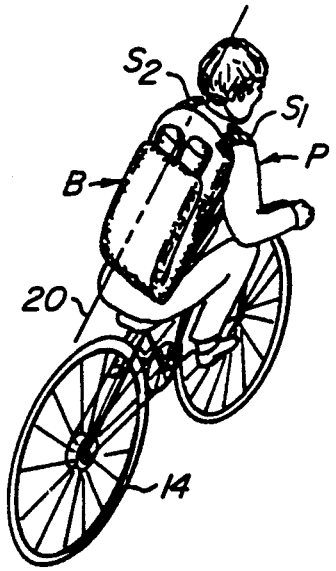
FIG. 1 is a perspective view of the back pack suit bag of this invention mounted to the back of a person undergoing rigorous athletic activity—here riding a bicycle.

Referring to FIG. 1, bag B of the invention is shown in use. Rider P is shown on bicycle 14. Bag B is held by straps S1 and S2 to the back of rider P. As will hereinafter be more fully developed, flexure of a semirigid panel within the bag B maintains stiffness of the bag relative to axis 20 substantially parallel to the spine of rider P.

Figure 2:
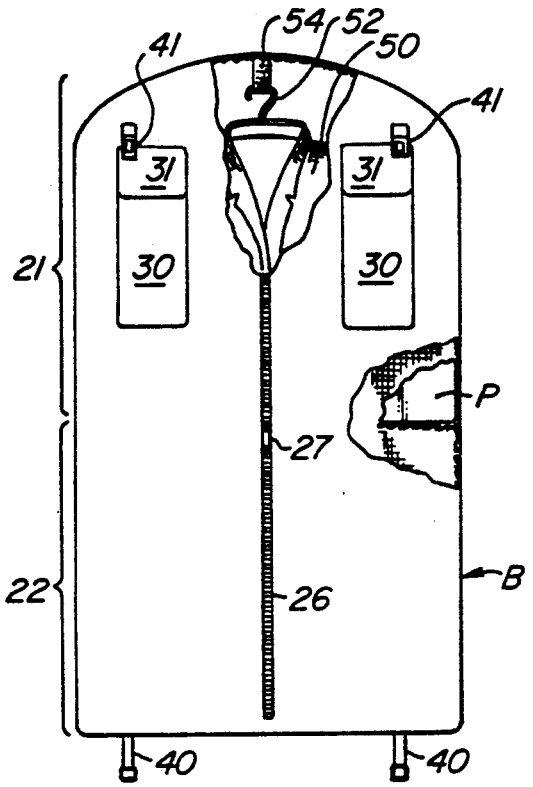
FIG. 2 is a front elevation of the back pack suit bag with portions of the bag broken away to expose a suit enclosed within the bag, the semirigid panel used for the strengthening of the bag, the depending portion of the bag, the shoe pockets and straps for holding the bag in a folded disposition during transport; and, FIG. 3 is a perspective view of the bag broken away at the panel portion only illustrating the arch of the semirigid panel parallel to the spine of a wearer (shown only in FIG. 1) with the strap imposed flexure of the bag being illustrated by panel and bag flexure at the bottom of the bag.

Referring to FIG. 2, suit bag B is illustrated in the unfolded disposition—where packing with a suit 50 previously hung to hanger 52 can occur. In order that the construction of bag B can be fully appreciated, placement of panel P will first be discussed. Thereafter, the depending portion of bag B relative to panel P will be discussed.

Bag B has sewn into the back exposed side of the bag B a semirigid panel. This panel is closely confined within the bag. The panel—through the material of bag B supports hanger strap 52 on one side and has back pack straps Sl and S2 on the opposite side.

It will be observed that back pack type straps S1 and S2 fasten at the upper central portion of the bag B at their respective upper ends 60. At their respective lower ends, straps S1 and S2 fasten at the exterior lower portion at the bottom of panel P at points 62. The respective straps S1 and S2 are conventionally adjustable and are tightened when the bag is worn. Such tightening effects an arcuate configuration to panel P bending the panel in an arch about an axis 20.

Bending of panel P about axis 20 in a slight arcuate configuration imparts columnar stiffness to panel P. Only a relatively slight bending of panel P need occur to produce this effect. When such bending occurs, load is easily transferred from straps S1 and S2 through panel P to hanging strap 54. Support of hanger 52 with garment(s) 50 can easily occur.

Because of the arcuate bending of the panel P, the disclosed suit bag B does not tend to flex normal to axis 20. Since a columnar force is developed to resist bending normal to axis 20, a secure and rigid support results.

Typically, bag B is opened at zipper 26 by sliding zipper car 27 to fully open the bag. Suit 50 on hanger 52 is placed within the bag and hung at strap 54. Thereafter, bag B is closed. Shoe pockets 30 having closing flaps 31 can be filled with shoes.

It will be preferred that the bag B be folded for transport. This being the case straps 40 from the bottom of bag B and 41 from the top of bag B can be connected to fold the lower portion 22 of bag B over the upper portion of bag B. Such a folded disposition is shown in FIG. 1.

It is preferred, but not required, that the suit bag B be fastened at the waist of rider P. This reinforces the arch of panel P parallel to axis 20 and at the same time secures suit bag B at the waist to prevent movement of panel P towards and away from the waist of rider P.

Figure 3:
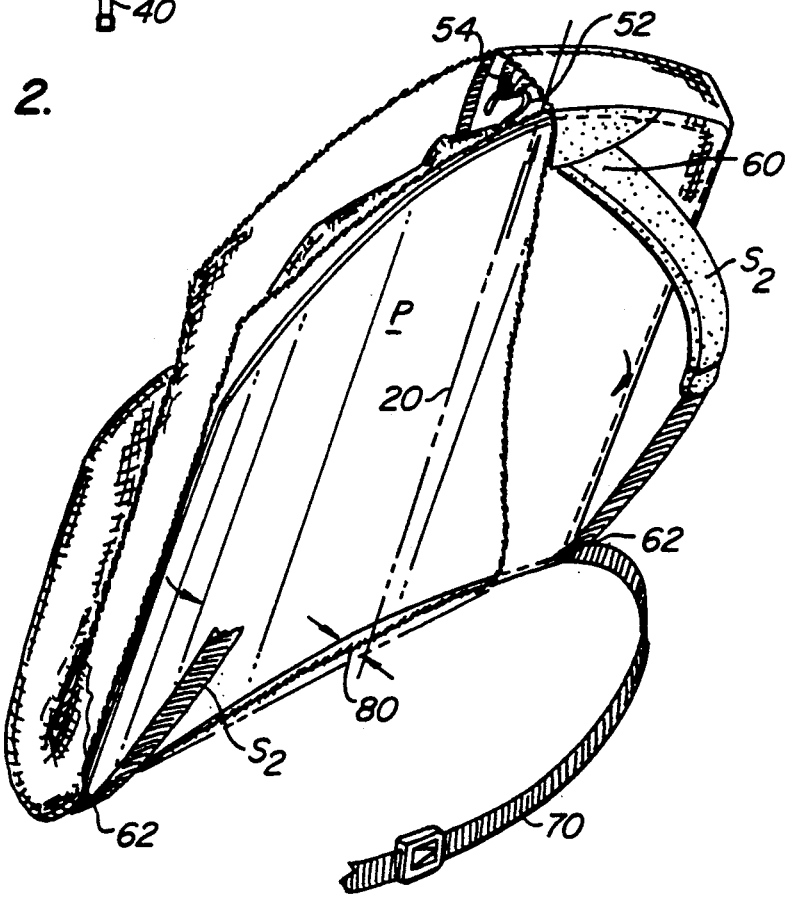

It is emphasized that only slight flexure or bending of panel P need occur. Such flexure from the straight disposition of bag B is shown at 80 in FIG. 3.

What is claimed is:

1. A back pack type suit bag for support from straps to the back of a person transporting said bag, said back pack type suit bag comprising:

a front panel wall exposed away from the back of said person transporting said bag;

a rear panel wall for confronting the back of said person transporting said bag, said rear panel wall centered to said back of the person transporting said bag about a vertical axis substantially parallel to the spine of the person transporting said bag;

side walls extending between said front and rear panel walls to space said front and rear panel walls apart from one another and to define a spatial interval interior of said bag for containing a garment;

means for opening and closing said bag for providing access to the interior of said bag defined in one of said walls;

a semirigid panel enclosed in said rear panel wall, said semirigid panel capable of flexure to an axially arcuate disposition about said vertical axis to conform to the back of a person transporting said bag;

means for supporting hanger suspended garments interior of said bag support from the top central portion of said semirigid wall;

first and second back pack type shoulder straps attached to said bag at said rear panel wall enclosing said semirigid panel, said straps each including an upper point of attachment adjacent the top of said semirigid panel and a lowering of attachment adjacent the bottom of said semirigid panel; said first and second straps mounted at the lower portion of said straps on opposite sides of said rear panel wall to exert a bending force on said semirigid panel along said vertical axis thereof whereby the results an arcuate deflection of said semirigid panel with a rigid column type support from the shoulder straps to said means for hanging the garments interior of the bag, a comfortable and conformed fit of the bag to the back of the wearer, as well as a surrounding encasement of the garment or suit by the semirigid panel in a substantially "wrinkle free" containment.

2. The invention of claim 1 and wherein said semirigid wall is co-extensive with the full width of the bag.

3. The invention of claim 1 and wherein said front panel wall defines an opening for permitting clothing items to be inserted interiorly of said bag.

4. The invention of claim 1 and including:

a waist strap at the bottom of said bag for maintaining said bag to the waist of a wearer and exerting said bending force on said semirigid panel along a vertical axis thereof.

5. The invention of claim 1 and wherein:

a portion of said bag hang down below said semirigid panel; and, means attached to said bag for permitting said hanging portion of said bag to be folded and fastened upwardly to the remainder of said bag.

6. In a suit bag having, a front panel wall exposed away from the back of said person transporting said bag;

a rear panel wall for confronting the back of said person transporting said bag, said rear panel wall centered to said back of the person transporting said bag about a vertical axis substantially parallel to the spine of the person transporting said bag;

side walls extending between said front and rear panel walls to space said front and rear panel walls apart from one another and to define a spatial interval interior of said bag for containing a garment;

means for opening and closing said bag for providing access to the interior of said bag defined in one of said walls;

the improvement to said suit bag comprising:

a semirigid panel enclosed in said rear panel wall, said semirigid panel capable of flexure to an axially arcuate disposition to conform to the back of a person transporting said bag;

means for supporting hanger suspended garments interior of said bag support from the top central portion of said semirigid wall;

first and second back pack type shoulder straps attached to said bag at said rear panel wall enclosing said semirigid panel, said straps each including an upper point of attachment adjacent the top of said semirigid panel and a lower point of attachment adjacent the bottom of said semirigid panel; said first and second straps mounted at the lower portion of said straps on opposite sides of said rear panel wall to exert a bending force on said semirigid panel along said vertical axis thereof whereby their results an arcuate deflection of said semirigid panel with a rigid column type support from the shoulder straps to said means for hanging the garments interior of the bag, a comfortable and conformed fit of the bag to the back of the wearer, as well as a surrounding encasement of the garment or suit by the semirigid panel in a substantially "wrinkle free" containment.

7. The invention of claim 6 and wherein said semirigid wall is co-extensive with the full width of the bag.

8. The invention of claim 6 and wherein said front panel wall defines an opening for permitting clothing items to be inserted interiorly of said bag.

9. The invention of claim 6 and including:

a waist strap at the bottom of said bag for maintaining said bag to the waist of a wearer and exerting said beginning force on said semirigid panel along a vertical axis thereof.

10. The invention of claim 6 and wherein:

a portion of said bag hang down below said semirigid panel; and, means attached to said bag for permitting said hanging portion of said bag to be folded and fastened upwardly to the remainder of said bag.

* * * * *